US010197951B2

(12) United States Patent
Sakurai et al.

(10) Patent No.: US 10,197,951 B2
(45) Date of Patent: Feb. 5, 2019

(54) IMAGE FORMING APPARATUS, IMAGE FORMING SYSTEM AND RECORDING MEDIUM

(71) Applicant: Konica Minolta, Inc., Chiyoda-ku, Tokyo (JP)

(72) Inventors: Shota Sakurai, Tokyo (JP); Hiroshi Morimoto, Tokyo (JP); Wataru Watanabe, Tokyo (JP); Kazuteru Ishizuka, Saitama (JP); Tatsuya Furuta, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/371,550

(22) Filed: Dec. 7, 2016

(65) Prior Publication Data

US 2017/0160679 A1 Jun. 8, 2017

(30) Foreign Application Priority Data

Dec. 8, 2015 (JP) ..... 2015-239535

(51) Int. Cl.
*G03G 15/16* (2006.01)
*G03G 15/00* (2006.01)
(Continued)

(52) U.S. Cl.
CPC ..... *G03G 15/1605* (2013.01); *B65H 18/103* (2013.01); *B65H 23/044* (2013.01);
(Continued)

(58) Field of Classification Search
CPC ..... G03G 15/1605
(Continued)

(56) References Cited

U.S. PATENT DOCUMENTS 5,023,668 A * 6/1991 Kluy ..... G03G 13/16 399/165
5,787,331 A * 7/1998 Ohkuma ..... B41J 3/60 162/271
(Continued)

FOREIGN PATENT DOCUMENTS

GB 1557652 A * 12/1979 ..... B41F 13/24
JP H06007952 U 2/1994
(Continued)

OTHER PUBLICATIONS

Extended European Search Report corresponding to Application No. 16201576.2-1568; dated Apr. 20, 2017.
(Continued)

*Primary Examiner* — Anthony Nguyen
(74) *Attorney, Agent, or Firm* — Cantor Colburn LLP

(57) ABSTRACT

An image forming apparatus includes: a conveyance section configured to convey a sheet in a direction opposite to a first conveyance direction during image formation, the direction being a second conveyance direction; and a distortion correction section disposed on an upstream side of a transfer nip in the first conveyance direction and configured to correct, when the sheet is conveyed by the conveyance section in the second conveyance direction, distortion of the sheet generated when the sheet passes through a fixing nip.

19 Claims, 8 Drawing Sheets

(51) Int. Cl.
*B65H 18/10* (2006.01)
*B65H 23/04* (2006.01)
*G03G 21/20* (2006.01)

(52) U.S. Cl.
CPC ..... *G03G 15/1695* (2013.01); *G03G 15/652* (2013.01); *G03G 15/6579* (2013.01); *B65H 2301/5142* (2013.01); *B65H 2511/214* (2013.01); *B65H 2515/314* (2013.01); *B65H 2801/06* (2013.01); *G03G 21/203* (2013.01); *G03G 2215/0059* (2013.01); *G03G 2215/0067* (2013.01); *G03G 2215/00578* (2013.01); *G03G 2215/00662* (2013.01); *G03G 2215/00738* (2013.01)

(58) Field of Classification Search
USPC ..... 399/384
See application file for complete search history.

(56) References Cited

U.S. PATENT DOCUMENTS 5,920,759 A * 7/1999 Ushiroji ..... B65H 29/12 162/271
8,135,297 B2 * 3/2012 Kobayashi ..... G03G 15/2039 399/69
9,616,655 B2 * 4/2017 Rancourt ..... B41F 13/025
9,776,819 B2 * 10/2017 Yamane ..... B65H 9/002
2006/0005722 A1 * 1/2006 Nobukawa ..... B41F 13/12 101/181
2006/0257181 A1 * 11/2006 Takano ..... G03G 15/652 399/384
2006/0269337 A1 * 11/2006 Yasumoto ..... G03G 15/232 399/388
2010/0080598 A1 * 4/2010 Nakazato ..... G03G 15/161 399/66
2010/0189447 A1 * 7/2010 Ishizuka ..... G03G 15/5062 399/15
2012/0112405 A1 * 5/2012 Hirota ..... B65H 7/08 271/227
2014/0044467 A1 * 2/2014 Murayama ..... G03G 15/6567 399/395
2015/0205258 A1 * 7/2015 Sugaya ..... G03G 15/6576 399/341
2015/0241833 A1 8/2015 Soda
2015/0316890 A1 * 11/2015 Okuda ..... B65H 23/26 399/341

FOREIGN PATENT DOCUMENTS

JP 10077152 A 3/1998
JP 2000007205 A 1/2000
JP 2001253622 A 9/2001
JP 2004054163 A 2/2004
JP 2010097132 A 4/2010
JP 2011183608 A 9/2011
JP 2012116641 A 6/2012
JP 2013028432 A 2/2013
JP 2015136896 A 7/2015
JP 2015178419 A 10/2015

OTHER PUBLICATIONS

Notice of Reasons for Rejection for corresponding JP Application No. 2015-239535; dated Mar. 6, 2018.

* cited by examiner

IMAGE FORMING APPARATUS, IMAGE FORMING SYSTEM AND RECORDING MEDIUM

CROSS REFERENCE TO RELATED APPLICATIONS

This application is entitled to and claims the benefit of Japanese Patent Application No. 2015-239535, filed on Dec. 8, 2015, the disclosure of which including the specification, drawings and abstract is incorporated herein by reference in its entirety.

BACKGROUND OF THE INVENTION

1. Field of the Invention

The present invention relates to an image forming apparatus, an image forming system and a recording medium.

2. Description of Related Art

Image forming apparatuses (printer, copier, facsimile or the like) using an electrophotographic process technique generally form an electrostatic latent image by irradiating (exposing) a charged photoconductor drum (image carrier) with laser light based on image data. Toner is supplied from a developing apparatus to the photoconductor drum on which the electrostatic latent image is formed, the electrostatic latent image is thereby visualized and a toner image is formed. Furthermore, the toner image is directly or indirectly transferred to a sheet, heated, pressurized and fixed by a fixing nip, and a toner image is thereby formed on the sheet.

When printing is done on continuous sheet (sheet) using such image forming apparatuses, base printing may be followed by overprinting whereby printing is further done thereon. Overprinting is done in two modes; one in which printing is done on all continuous sheet once and printing is then done on the continuous sheet over again from the beginning, and the other in which printing is stopped halfway, fixing and transfer are cancelled once, and continuous sheet is rewound up to a position where overprinting starts, then the continuous sheet is sent again for second printing. Here, from the standpoint of labor-saving, the mode of rewinding continuous sheet is more desirable.

For example, when base printing is done on only several centimeters of several hundreds of meters of continuous sheet, rewinding may improve work efficiency because it is possible to reduce time and effort required for printing several hundreds of meters of continuous sheet. On the other hand, in the mode in which rewinding is performed, continuous sheet is rewound and a fixing process is performed twice, and it is thereby possible to improve glossiness of continuous sheet.

For example, Japanese Patent Application Laid-Open No. 2010-97132 discloses a configuration in which rewinding is performed once when a suspended printing process is resumed so as not to produce any excessive blank portion in continuous sheet. In the configuration disclosed in Japanese Patent Application Laid-Open No. 2010-97132, when the printing process is resumed, it is possible to synchronize the position of a toner image on the continuous sheet with the transfer, fixing and pressure-contacting positions through rewinding.

However, since the amount of water of the continuous sheet that has once passed through the fixing portion is changed by heating and the continuous sheet contracts, when the toner image region is arranged biased to one side in the width direction of the continuous sheet during base printing, one side of the continuous sheet contracts, which causes partial distortion on the continuous sheet. For that reason, if the continuous sheet is rewound, resent and fixed in such a case, wrinkles are produced in the continuous sheet. With the continuous sheet in particular, such a problem is likely to occur because the toner image often has the same pattern in the conveyance direction.

SUMMARY OF THE INVENTION

An object of the present invention is to provide an image forming apparatus, an image forming system and a recording medium capable of preventing wrinkles in a sheet when the sheet is rewound and resent.

In order to achieve the object mentioned above, an image forming apparatus reflecting at least one aspect of the present invention includes: a conveyance section configured to convey a sheet in a direction opposite to a first conveyance direction during image formation, the direction being a second conveyance direction; and a distortion correction section disposed on an upstream side of a transfer nip in the first conveyance direction and configured to correct, when the sheet is conveyed by the conveyance section in the second conveyance direction, distortion of the sheet generated when the sheet passes through a fixing nip.

Desirably, in the image forming apparatus, the distortion correction section includes a distortion detection section configured to detect an amount of distortion generated when the sheet passes through the fixing nip, and the distortion correction section controls an amount of distortion correction of the sheet in accordance with the amount of distortion detected by the distortion detection section.

Desirably, in the image forming apparatus, the distortion detection section detects an amount of inclination in a width direction of the sheet conveyed in the second conveyance direction, and the distortion correction section calculates the amount of distortion of the sheet in accordance with the amount of inclination detected by the distortion detection section.

Desirably, in the image forming apparatus, the distortion detection section comes into contact with the sheet conveyed by the conveyance section and thereby detects a contact pressure of the sheet with respect to the distortion detection section, and the distortion correction section calculates the amount of distortion of the sheet in accordance with the amount of inclination detected by the distortion detection section and the contact pressure detected by the distortion detection section.

Desirably, in the image forming apparatus, the distortion correction section humidifies the sheet to thereby correct distortion of the sheet.

Desirably, in the image forming apparatus, the distortion correction section includes a pair of humidification rollers configured to humidify the sheet, and the distortion correction section causes the pair of humidification rollers to be in pressure-contact with the sheet when the sheet is conveyed in the second conveyance direction and distortion occurs in the sheet, and the distortion correction section causes the pair of humidification rollers to separate from each other when the sheet is conveyed in the second conveyance direction and no distortion occurs in the sheet.

Desirably, in the image forming apparatus, when the sheet is conveyed in the first conveyance direction, the distortion correction section causes the pair of humidification rollers to separate from each other.

Desirably, in the image forming apparatus, the distortion correction section controls the amount of humidification of the sheet in accordance with the amount of distortion of the sheet.

Desirably, in the image forming apparatus, the distortion correction section corrects curling of the sheet to thereby correct distortion of the sheet.

Desirably, in the image forming apparatus, the distortion correction section controls the amount of distortion correction on the sheet in accordance with information on a toner image formed on the sheet.

Desirably, in the image forming apparatus, the distortion correction section controls the conveyance section so that the sheet is conveyed toward the second conveyance direction and then conveyed in the first conveyance direction.

In order to achieve the abovementioned object, an image forming system reflecting one aspect of the present invention is composed of a plurality of units including an image forming apparatus, the image forming system including: a conveyance section configured to convey a sheet in a direction opposite to a first conveyance direction during image formation, the direction being a second conveyance direction; and a distortion correction section disposed on an upstream side of a transfer nip in the first conveyance direction and configured to correct, when the sheet is conveyed by the conveyance section in the second conveyance direction, distortion of the sheet generated when the sheet passes through a fixing nip.

In order to achieve the abovementioned object, a computer-readable recording medium reflecting an aspect of the present invention is a medium storing therein a program for causing a computer of an image forming apparatus to execute processing including: conveying a sheet in a direction opposite to a first conveyance direction during image formation, the direction being a second conveyance direction; and correcting, on an upstream side of a transfer nip in the first conveyance direction when the sheet is conveyed in the second conveyance direction, distortion of the sheet generated when the sheet passes through a fixing nip.

Desirably, in the computer-readable recording medium, the program causes the computer of the image forming apparatus to execute processing further including: detecting an amount of distortion generated when the sheet passes through the fixing nip; and controlling an amount of distortion correction of the sheet in accordance with the detected amount of distortion.

Desirably, in the computer-readable recording medium, the program causes the computer of the image forming apparatus to execute processing further including: detecting an amount of inclination in a width direction of the sheet conveyed in the second conveyance direction; and calculating the amount of distortion of the sheet in accordance with the detected amount of inclination.

Desirably, in the computer-readable recording medium, the program causes the computer of the image forming apparatus to execute processing further including: detecting a contact pressure on a part in contact with the sheet being conveyed; and calculating an amount of distortion of the sheet in accordance with the detected amount of inclination and the detected contact pressure.

Desirably, in the computer-readable recording medium, the program causes the computer of the image forming apparatus to execute processing further including humidifying the sheet to thereby correct distortion of the sheet.

Desirably, in the computer-readable recording medium, the image forming apparatus includes a pair of humidification rollers configured to humidify the sheet, and the program causes the computer of the image forming apparatus to execute processing further comprising causing the pair of humidification rollers to be in pressure-contact with the sheet when the sheet is conveyed in the second conveyance direction and distortion occurs in the sheet, and causing the pair of humidification rollers to separate from each other when the sheet is conveyed in the second conveyance direction and no distortion occurs in the sheet.

Desirably, in the computer-readable recording medium, the program causes the computer of the image forming apparatus to execute processing further including causing the pair of humidification rollers to separate from each other when the sheet is conveyed in the first conveyance direction.

Desirably, in the computer-readable recording medium, the program causes the computer of the image forming apparatus to execute processing further including controlling the amount of humidification of the sheet in accordance with the amount of distortion of the sheet.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
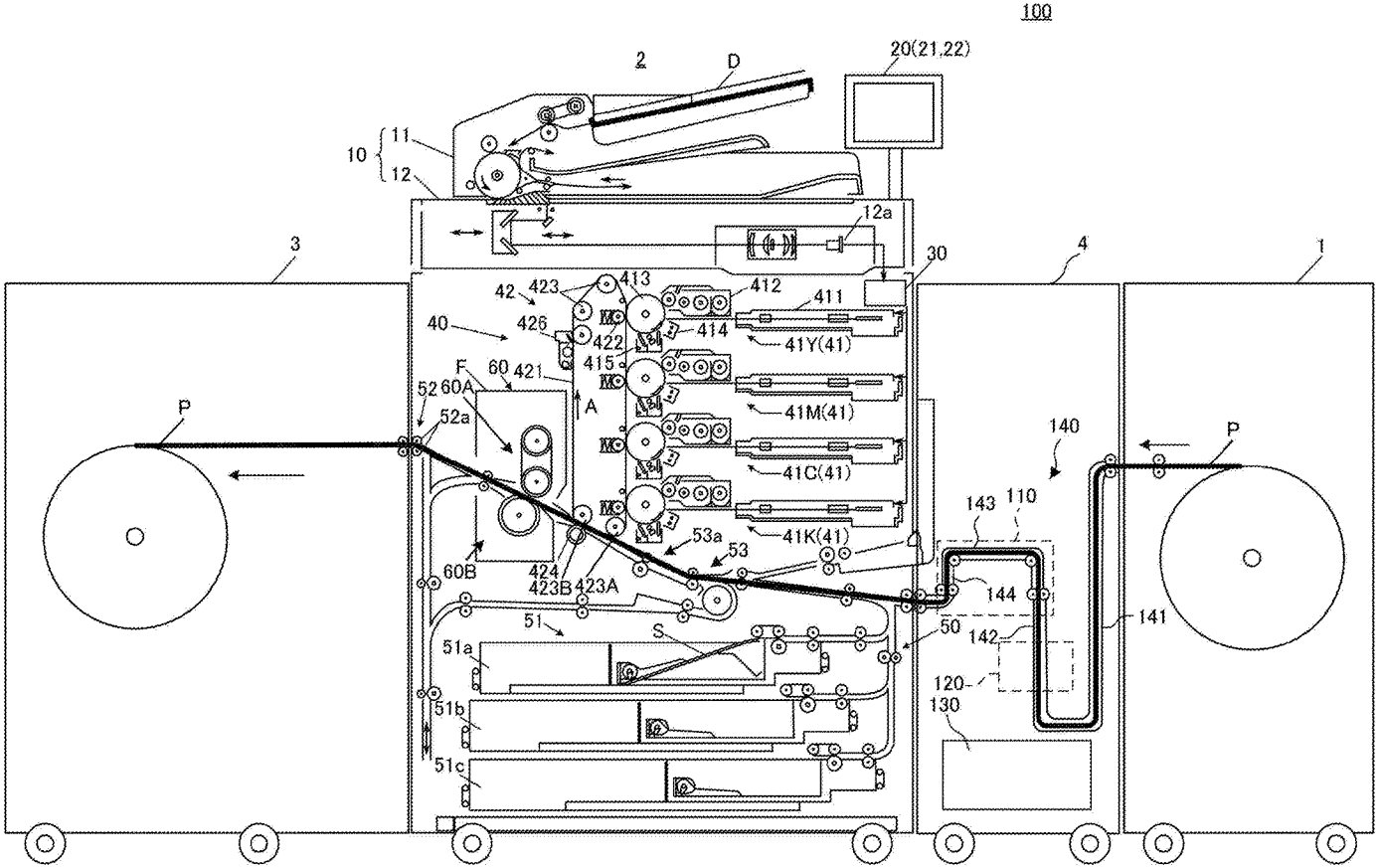
FIG. 1 is a diagram schematically illustrating an overall configuration of an image forming system according to the present embodiment.
Figure 2:
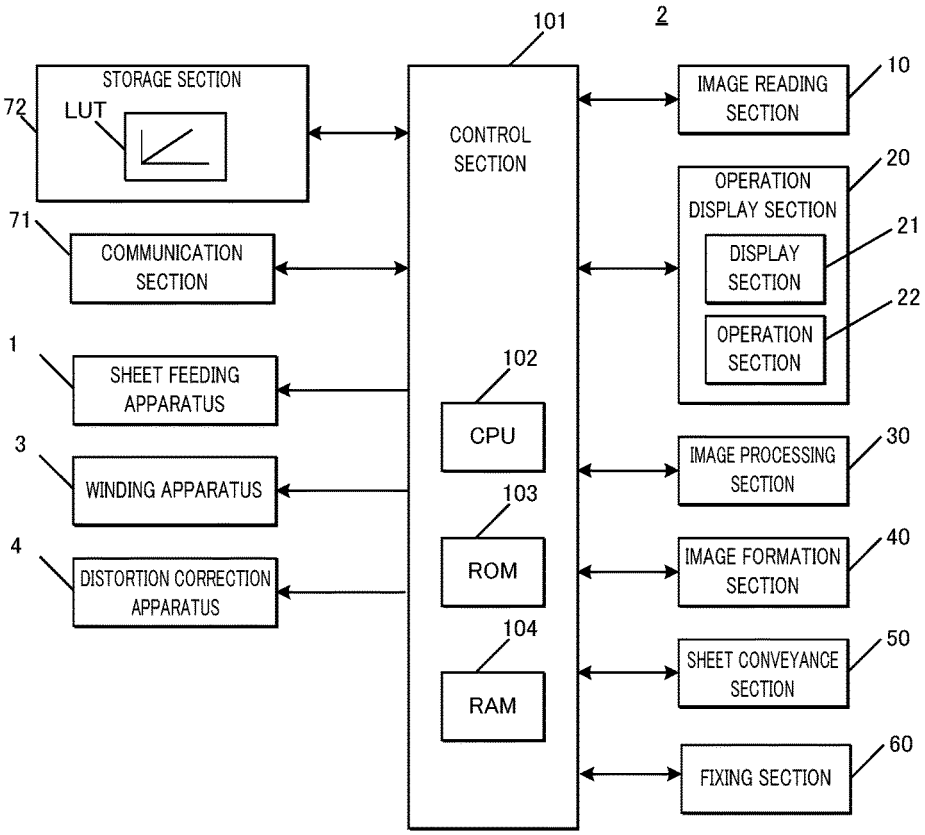
FIG. 2 is a diagram illustrating main parts of a control system of the image forming apparatus of the present embodiment.

Hereinafter, an embodiment of the present invention will be described in detail based on the accompanying drawings. FIG. 1 is a diagram schematically illustrating an overall configuration of image forming system 100 according to the present embodiment. FIG. 2 illustrates main parts of a control system of image forming apparatus 2 provided for image forming system 100 according to the present embodiment.

Image forming system 100 uses long sheet P or sheet S (non-long sheet) shown by a thick line in FIG. 1 as a sheet and is a system that forms images on long sheet P or sheet S. Here, long sheet P is a sheet having a length exceeding, for example, a body width of image forming apparatus 2 in a conveyance direction and includes a roll sheet or continuous sheet. Long sheet P corresponds to a "sheet" in the present invention.

As shown in FIG. 1, image forming system 100 is configured by connecting sheet feeding apparatus 1, distortion correction apparatus 4, image forming apparatus 2 and winding apparatus 3 from an upstream side along a conveyance direction of long sheet P (hereinafter also referred to as a "first conveyance direction"). Sheet feeding apparatus 1, winding apparatus 3 and distortion correction apparatus 4 are used when an image is formed on long sheet P.

Sheet feeding apparatus 1 is an apparatus that feeds long sheet P to image forming apparatus 2 via distortion correction apparatus 4. In a casing of sheet feeding apparatus 1, as shown in FIG. 1, long sheet P is wound around a support shaft in a roll form and rotatably held. Sheet feeding apparatus 1 conveys long sheet P wound around the support shaft to image forming apparatus 2 via a plurality of conveyance roller pairs such as delivering rollers, sheet feeding rollers at a certain speed. Sheet feeding operation of sheet feeding apparatus 1 is controlled by control section 101 provided for image forming apparatus 2.

Image forming apparatus 2 is an intermediate transfer type color image forming apparatus using an electrophotographic process technique. That is, image forming apparatus 2 forms an image by primary-transferring toner images formed in different colors of Y (yellow), M (magenta), C (cyan) and K (black) on photoconductor drum 413 to intermediate transfer belt 421, superimposing the four color toner images one on another on intermediate transfer belt 421 and then secondary-transferring the superimposed image to long sheet P fed from sheet feeding apparatus 1 or sheet S sent from sheet feeding tray units 51*a* to 51*c*.

Image forming apparatus 2 adopts a tandem scheme in which photoconductor drums 413 corresponding to four YMCK colors are arranged in series in a traveling direction of intermediate transfer belt 421 and toner images of the respective colors are sequentially transferred to intermediate transfer belt 421 by one procedure.

As shown in FIG. 2, image forming apparatus 2 is provided with image reading section 10, operation display section 20, image processing section 30, image formation section 40, sheet conveying section 50, fixing section 60 and control section 101.

Control section 101 is provided with CPU (central processing unit) 102, ROM (read only memory) 103, RAM (random access memory) 104 or the like. CPU 102 reads a program corresponding to processing contents from ROM 103, develops the program on RAM 104 and intensively controls operation of each block of image forming apparatus 2 in cooperation with the developed program. In this case, various kinds of data stored in storage section 72 are referenced. Storage section 72 is constructed of, for example, a non-volatile semiconductor memory (so-called flash memory) or a hard disk drive.

Control section 101 transmits and/or receives various kinds of data to/from an external apparatus (e.g., personal computer) connected to a communication network such as LAN (local area network) or WAN (wide area network) via communication section 71. Control section 101 receives, for example, image data (input image data) transmitted from the external apparatus and forms an image on long sheet P or sheet S based on the image data. Communication section 71 is made up of a communication control card such as a LAN card.

As shown in FIG. 1, image reading section 10 is provided with auto document feeding apparatus 11 called "auto document feeder (ADF)" and document image scanning apparatus 12 (scanner) or the like.

Auto document feeder 11 conveys document D placed on a document tray through a conveyance mechanism and sends document D to document image scanning apparatus 12. Auto document feeder 11 allows images (including both sides) of many pieces of document D placed on the document tray to be consecutively read at a stretch.

Document image scanning apparatus 12 optically scans a document conveyed from auto document feeder 11 onto contact glass or a document placed on the contact glass, forms an image of reflected light from the document on a light receiving surface of CCD (charge coupled device) sensor 12*a* and reads the document image. Image reading section 10 generates input image data based on the reading result from document image scanning apparatus 12. The input image data is subjected to predetermined image processing by image processing section 30.

As shown in FIG. 2, operation display section 20 is made up of, for example, a liquid crystal display (LCD) with a touch panel and functions as display section 21 and operation section 22. Display section 21 displays various operation screens, states of images and operation situations or the like of the respective functions according to display control signals inputted from control section 101. Operation section 22 is provided with various operation keys such as a numerical keypad or a start key, receives various input operations from a user and outputs operation signals to control section 101.

Image processing section 30 is provided with a circuit that performs digital image processing corresponding to an initial setting or user setting on the input image data. For example, image processing section 30 performs gradation correction based on gradation correction data (gradation correction table) under the control of control section 101. Image processing section 30 performs various correction processes such as color correction, shading correction and compression process in addition to gradation correction on the input image data. Image formation section 40 is controlled based on the image data subjected to these processes.

As shown in FIG. 1, image formation section 40 is provided with image formation units 41Y, 41M, 41C and 41K for forming images using colored toners of a Y component, an M component, a C component and a K component based on the input image data, and intermediate transfer unit 42 or the like.

Image formation units 41Y, 41M, 41C and 41K for the Y component, M component, C component and K component have similar configurations respectively. For convenience of illustration and description, common components are shown by the same reference numerals and when components are distinguished, their reference numerals are appended by Y, M, C and K. In FIG. 1, only components of Y component image formation unit 41Y are assigned reference numerals and reference numerals of components of other image formation units 41M, 41C and 41K are omitted.

Image formation unit 41 is provided with exposure apparatus 411, developing apparatus 412, photoconductor drum 413, charging apparatus 414 and drum cleaning apparatus 415 or the like.

Photoconductor drum 413 is made up of an organic photoreceptor in which resin photoconductive layer containing an organic photoconductor is formed on a circumferential surface of, for example, a drum-like metal substrate.

Control section 101 causes photoconductor drum 413 to rotate at a certain circumferential speed by controlling a drive current supplied to a drive motor (not shown) that causes photoconductor drum 413 to rotate.

Charging apparatus 414 is, for example, an electrification charger and uniformly charges the surface of photoconductor drum 413 having photoconductivity to a negative polarity by generating corona discharge.

Exposure apparatus 411 is constructed of, for example, a semiconductor laser and irradiates photoconductor drum 413 with laser light corresponding to an image of each color component. As a result, an electrostatic latent image of each color component is formed in an image region irradiated with the laser light of the surface of photoconductor drum 413 due to a potential difference from a background region.

Developing apparatus 412 is a two-component reverse rotation type developing apparatus and forms a toner image by causing a developer of each color component to adhere to the surface of photoconductor drum 413 and thereby visualizing the electrostatic latent image.

A DC developing bias having the same polarity as the charging polarity of, for example, charging apparatus 414 or a developing bias which is an AC voltage on which a DC voltage having the same polarity as the charging polarity of charging apparatus 414 is superimposed is applied to developing apparatus 412. As a result, reversal development is conducted whereby toner is adhered to the electrostatic latent image formed by exposure apparatus 411.

Drum cleaning apparatus 415 includes a plate-shaped drum cleaning blade made of an elastic body that comes into contact with the surface of photoconductor drum 413 and removes toner remaining on the surface of photoconductor drum 413 without being transferred to intermediate transfer belt 421.

Intermediate transfer unit 42 is provided with intermediate transfer belt 421, primary transfer roller 422, a plurality of support rollers 423, secondary transfer roller 424 and belt cleaning apparatus 426 or the like. Secondary transfer roller 424 corresponds to a transfer section of the present invention.

Intermediate transfer belt 421 is constructed of an endless belt and is stretched in a loop shape among a plurality of support rollers 423. At least one of the plurality of support rollers 423 is made up of a drive roller and the other rollers are made up of driven rollers. For example, roller 423A disposed on a downstream side of K-component primary transfer roller 422 in the belt running direction is preferably a drive roller. This makes it easier to keep the belt running speed in the primary transfer section constant. When drive roller 423A rotates, intermediate transfer belt 421 travels in a direction indicated by arrow A at a certain speed.

Intermediate transfer belt 421 is a conductive and elastic belt and has a high resistance layer on the surface. Intermediate transfer belt 421 is driven to rotate by a control signal from control section 101.

Primary transfer roller 422 is disposed on an inner circumferential surface side of intermediate transfer belt 421 opposite to photoconductor drum 413 of each color component. Primary transfer roller 422 is brought into pressure-contact with photoconductor drum 413 via intermediate transfer belt 421 interposed therebetween and a primary transfer nip for transferring a toner image from photoconductor drum 413 to intermediate transfer belt 421 is thereby formed.

Secondary transfer roller 424 is disposed on an outer circumferential surface side of intermediate transfer belt 421 opposite to backup roller 423B disposed on a downstream side of drive roller 423A in a belt running direction. Secondary transfer roller 424 is brought into pressure-contact with backup roller 423B via intermediate transfer belt 421 interposed therebetween and a secondary transfer nip for transferring a toner image from intermediate transfer belt 421 to long sheet P or sheet S is thereby formed.

When intermediate transfer belt 421 passes through the primary transfer nip, toner images on photoconductor drums 413 are primary-transferred while being superimposed on intermediate transfer belt 421 one on top of another. More specifically, by applying a primary transfer bias to primary transfer roller 422 and adding a charge with a polarity opposite to that of the toner to the rear side of intermediate transfer belt 421, that is, a side to be in contact with primary transfer roller 422, the toner images are electrostatically transferred to intermediate transfer belt 421.

After that, when long sheet P or sheet S passes through the secondary transfer nip, the toner images on intermediate transfer belt 421 are secondary-transferred to long sheet P or sheet S. More specifically, by applying a secondary transfer bias to secondary transfer roller 424 and adding a charge with the polarity opposite to that of the toner to the rear side of long sheet P or sheet S, that is, a side to be in contact with secondary transfer roller 424, the toner images are electrostatically transferred to long sheet P or sheet S. Long sheet P or sheet S to which the toner images are transferred is conveyed to fixing section 60.

Belt cleaning apparatus 426 removes residual transferred toner remaining on the surface of intermediate transfer belt 421 after a secondary transfer. Note that, instead of secondary transfer roller 424, a so-called belt type secondary transfer unit may be adopted in which a secondary transfer belt is stretched in a loop shape among a plurality of support rollers including the secondary transfer roller.

Fixing section 60 is provided with upper side fixing section 60A having a fixing surface side member disposed on the surface side on which toner images are formed, which is a fixing surface of long sheet P or sheet S and lower side fixing section 60B having a back side support member disposed on the surface side opposite to the fixing surface which is the back side of long sheet P or sheet S, a heating source or the like. A fixing nip to nip and convey long sheet P or sheet S is formed by causing the back side support member to be in pressure-contact with the fixing surface side member.

Fixing section 60 heats and pressurizes, through the fixing nip, conveyed long sheet P or sheet S to which toner images are secondary-transferred to thereby fix the toner images to long sheet P or sheet S. Fixing section 60 is disposed in fixing device F as a unit. An air separation unit that separates long sheet P or sheet S from the fixing surface side member or the back side support member by blowing air may be disposed in fixing device F.

Sheet conveying section 50 is provided with sheet feed section 51, sheet ejection section 52 and conveyance path section 53 or the like. Three sheet feed tray units 51*a* to 51*c* that constitute sheet feed section 51 accommodate sheets S (standard sheet and special sheet) which are identified based on a weighing capacity or size or the like for each type set in advance. Conveyance path section 53 includes a plurality of conveyance roller pairs including resist roller pairs 53*a*. The resist roller section in which resist roller pairs 53*a* are disposed corrects the inclination and deviation of sheet S or long sheet P.

Sheets S accommodated in sheet feed tray units 51*a* to 51*c* are sent by conveyance path section 53 one by one starting from a topmost sheet and conveyed to image formation section 40. Toner images on intermediate transfer belt 421 in image formation section 40 are collectively secondary-transferred to one surface of sheet S and subjected to a fixing step in fixing section 60.

Long sheet P fed from sheet feeding apparatus 1 to image forming apparatus 2 is conveyed to image formation section 40 by conveyance path section 53. In image formation section 40, toner images on intermediate transfer belt 421 are collectively secondary-transferred to one surface of long sheet P and subjected to a fixing step in fixing section 60. Long sheet P or sheet S on which an image is formed is conveyed to winding apparatus 3 by sheet ejection section 52 provided with conveyance roller pair (sheet ejection roller pair) 52*a*.

Winding apparatus 3 is an apparatus that winds long sheet P conveyed from image forming apparatus 2. Inside a casing of winding apparatus 3, for example, long sheet P is wound around the support shaft and held in a roll shape. For that reason, winding apparatus 3 winds long sheet P conveyed from image forming apparatus 2 around the support shaft via a plurality of conveyance roller pairs (e.g., delivering roller, sheet ejection roller) at a certain speed. The winding operation of winding apparatus 3 is controlled by control section 101 provided for image forming apparatus 2.

Furthermore, in the present embodiment, when, for example, overprinting is performed, control section 101 controls sheet feeding apparatus 1, distortion correction apparatus 4 and sheet conveyance section 50 to thereby wind long sheet P. Sheet feeding apparatus 1, distortion correction apparatus 4 and sheet conveyance section 50 correspond to a "conveyance section" of the present invention and control section 101 and distortion correction apparatus 4 correspond to a "distortion correction section" of the present invention.

More specifically, after long sheet P is subjected to base printing, conveyance of long sheet P in a first conveyance direction is stopped, pressure-contacting of the fixing nip portion and the secondary transfer nip portion is released and long sheet P is conveyed in a second conveyance direction opposite to the first conveyance direction. After long sheet P is rewound up to the overprinting position, the fixing nip portion and the secondary transfer nip portion are brought into pressure-contact again and long sheet P is conveyed toward the first conveyance direction again.

The amount of water of long sheet P which has passed through the fixing nip once is changed by heating and long sheet P contracts, and therefore when the toner image region during base printing is disposed at a position biased to one side in the width direction of continuous sheet, partial distortion is produced in long sheet P.

In the present embodiment, when long sheet P is rewound, distortion correction apparatus 4 corrects distortion of long sheet P. Hereinafter, details of distortion correction apparatus 4 will be described.

Distortion correction apparatus 4 is located between sheet feeding apparatus 1 and image forming apparatus 2, that is, on the upstream side of the transfer nip in the first conveyance direction, and is provided with distortion detection section 110, humidification section 120, water storage part 130 and conveyance path 140. Water storage part 130 is a container that contains water and disposed below humidification section 120. Water in water storage part 130 is sent to humidification section 120 through operation of a pump (not shown) passing through a water delivery path (not shown).

Conveyance path 140 is a path between sheet feeding apparatus 1 and image forming apparatus 2 to convey long sheet P, and includes first path 141 that extends downward from a connection position between sheet feeding apparatus 1 and distortion correction apparatus 4 and then extends in the left direction in the drawing, second path 142 that extends upward from the left end of first path 141 in the drawing, third path 143 that extends from a top end of second path 142 in the left direction in the drawing, and fourth path 144 that extends downward from the left end of third path 143 in the drawing, then extends in the left direction in the drawing and is connected to image forming apparatus 2.

Distortion detection section 110 is located at an upper part of second path 142 and at an upper part of third path 143 and fourth path 144, and humidification section 120 is located below distortion detection section 110 in second path 142. That is, when long sheet P is conveyed in the second conveyance direction, distortion detection section 110 and humidification section 120 are arranged in that order from the upstream side in the second conveyance direction.

Figure 3:
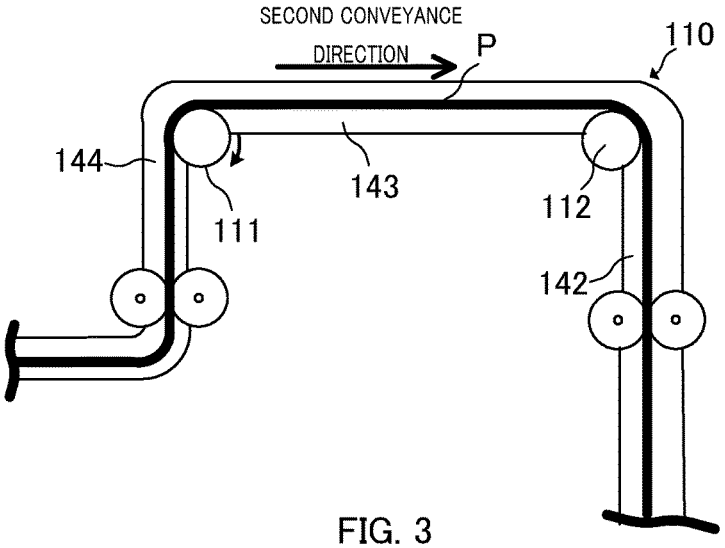
FIG. 3 is an enlarged view of a distortion detection section.

As shown in FIG. 3, distortion detection section 110 includes first roller 111 and second roller 112 that are in contact with the back side of long sheet P in third path 143. First roller 111 is disposed at a position corresponding to an upstream end in the second conveyance direction in third path 143 and is rotatably supported at an appropriate position in distortion correction apparatus 4.

Figure 4:
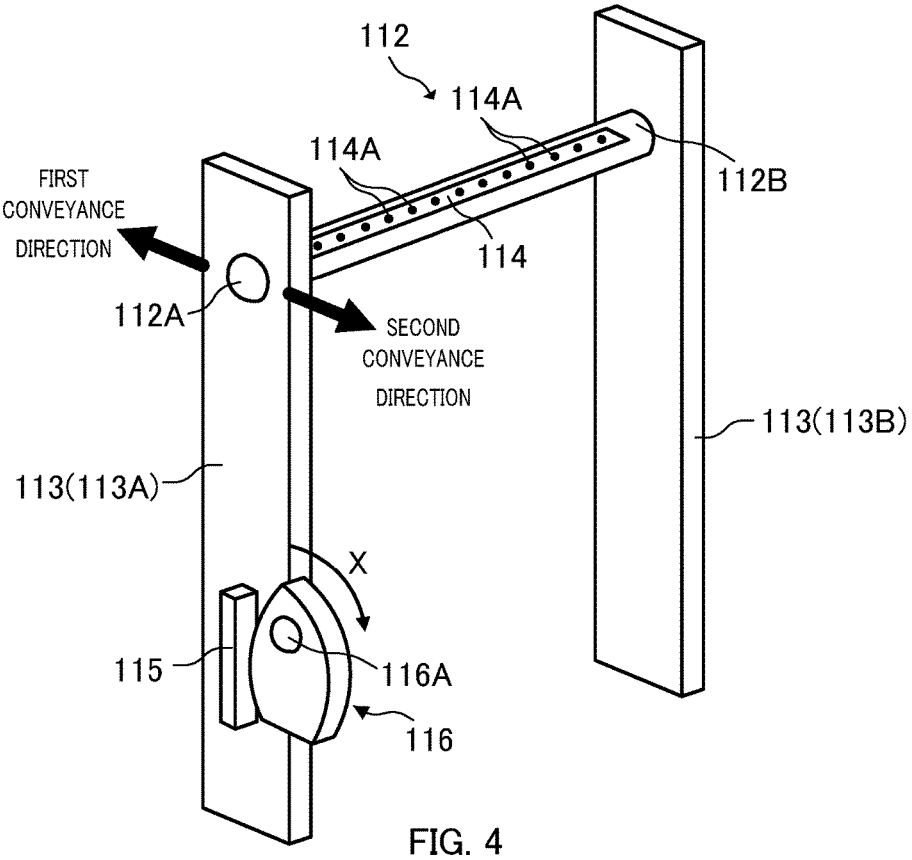
FIG. 4 is a perspective view of a second roller and a pair of side walls that support the second roller.

Second roller 112 is disposed at a position corresponding to a downstream end of third path 143 in the second conveyance direction, and as shown in FIG. 4, second roller 112 is unrotatably supported by a pair of side walls 113 located in distortion correction apparatus 4. Detection section 114 is provided on a contact surface between second roller 112 and long sheet P, which comes into contact with long sheet P and detects a contact pressure with respect to long sheet P.

Detection section 114 includes a plurality of contactors 114A arranged side by side in an axial direction of second roller 112. When contactors 114A come into contact with long sheet P which is being conveyed, detection section 114 detects a difference in frictional force in the width direction of long sheet P, that is, detection section 114 detects distortion in the width direction of long sheet P and outputs the detected difference to control section 101.

Side wall 113A disposed on one side in the axial direction of the pair of side walls 113 that support second roller 112 is configured to be movable in the first conveyance direction or the second conveyance direction. On the other hand, other side wall 113B in the axial direction is configured to be immovable in either the first conveyance direction or the second conveyance direction. Plate-shaped pressed portion 115 which protrudes from a position below second roller 112 is provided on a side face of side wall 113A.

Cam 116 that presses pressed portion 115 is provided on a downstream side of pressed portion 115 in the second conveyance direction. Cam 116 is supported rotatably around axis of rotation 116A parallel to an axial direction of second roller 112 at an appropriate position in distortion correction apparatus 4. Furthermore, pressed portion 115 is urged by an urging member (not shown) in the second conveyance direction, that is, toward cam 116.

Cam 116 rotates in the X direction under the control of control section 101, presses pressed portion 115 in the first conveyance direction and thereby causes side wall 113A to move in the first conveyance direction. Furthermore, cam 116 rotates in a direction opposite to the X direction, moves toward a side away from pressed portion 115, and along with this movement, pressed portion 115 moves in the second conveyance direction by an urging force of the urging member while remaining in contact with cam 116.

Thus, when side wall 113A moves, second roller 112 swings in the first conveyance direction or the second conveyance direction centered on end 112B on the other side in the axial direction, and it is thereby made possible to correct an inclination of conveyed long sheet P.

Figure 5:
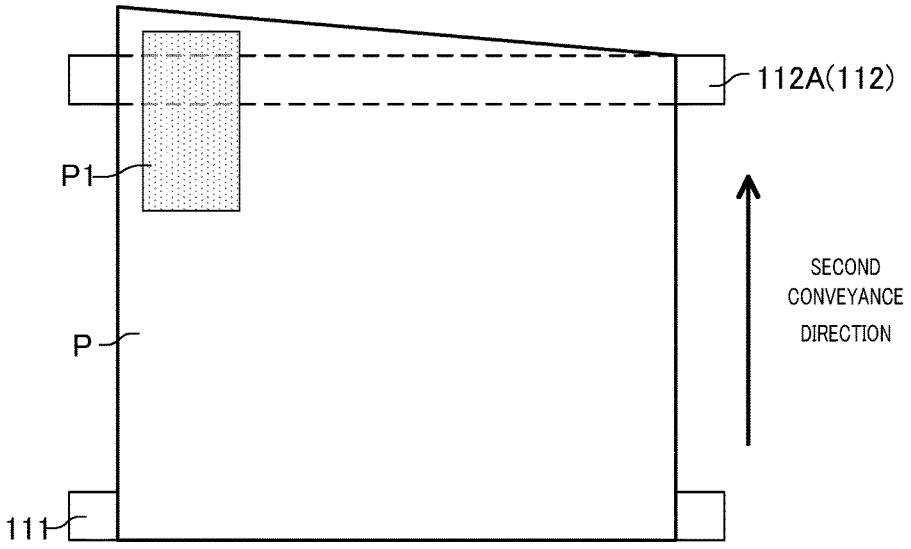
FIG. 5 is a diagram illustrating a situation in which a long sheet is inclined on the second roller.

More specifically, as shown in FIG. 5, when distortion P1 occurs on the other side (left side in the drawing) in the width direction of long sheet P, long sheet P which is being conveyed in the second conveyance direction is conveyed with the other side being inclined at a part of second roller 112, that is, with the other side protruding in the second conveyance direction more than the one side (right side in the drawing).

Figure 6:
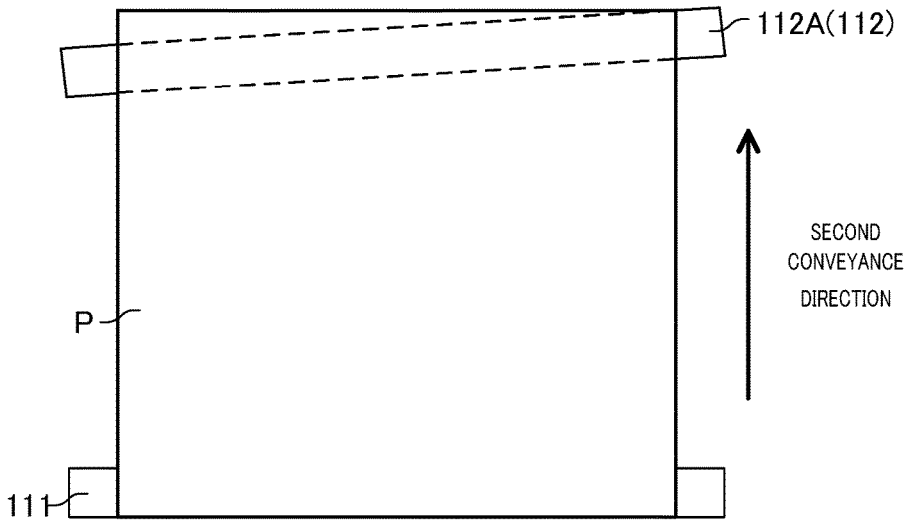
FIG. 6 is a diagram illustrating a situation in which an inclination of the long sheet is corrected by the second roller.

In this case, as shown in FIG. 6, when one end 112A of second roller 112 is inclined toward the second conveyance direction, one side of long sheet P is pushed toward the second conveyance direction, and therefore the inclination of relatively long sheet P is corrected. Distortion detection section 110 detects the inclination of long sheet P with respect to the width direction according to the amount of inclination of second roller 112 and outputs the inclination to control section 101. Control section 101 calculates the amount of distortion of long sheet P from the amount of inclination of long sheet P and the distortion of aforementioned long sheet P.

Figure 7:
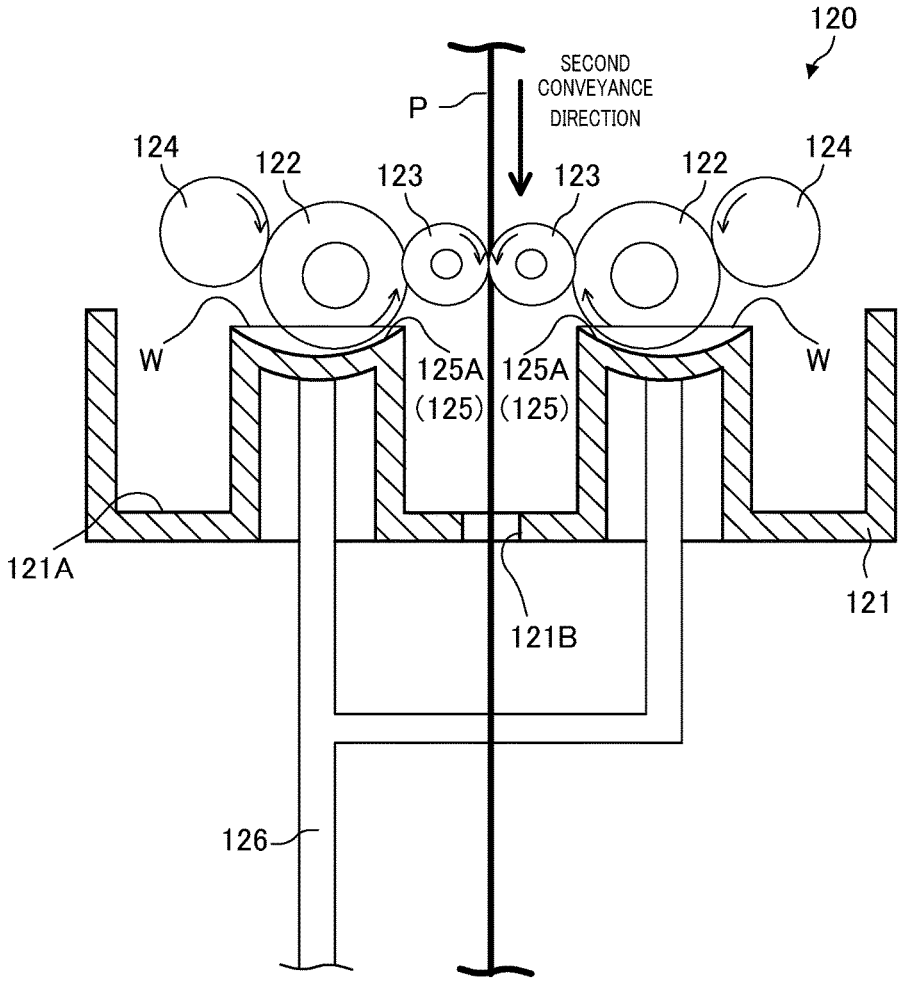
FIG. 7 is a diagram illustrating a humidification section when the long sheet is conveyed in a second conveyance direction.

As shown in FIG. 7, humidification section 120 is a part that corrects distortion of long sheet P by humidifying long sheet P and is provided with water-boat 121, supply roller 122, humidification roller 123 and draining roller 124.

Water-boat 121 is located below each roller and configured into a box shape surrounding each roller. Hole 121B to allow long sheet P to pass therethrough is formed in the center of bottom surface 121A of water-boat 121. Rollers are provided in pairs across long sheet P that passes through hole 121B, and reservoir part 125 in which water W in water storage part 130 is stored is provided at a position opposite to each water feed roller 122 of water-boat 121.

Reservoir part 125 is provided so as to protrude from bottom surface 121A of water-boat 121, and top surface 125A opposite to supply roller 122 forms a circular surface along the outer circumference of supply roller 122. Water feed path 126 through which water W from water storage part 130 is sent is connected to reservoir part 125 so that water W from water storage part 130 can be stored on top surface 125A.

Supply roller 122 is in contact with water W stored in reservoir part 125 and is configured to supply water W to humidification roller 123 by rotating while keeping water W on the outer circumferential surface.

Outer circumferential surfaces of the pair of humidification rollers 123 are in contact with each other and the outer circumferential surfaces on the side opposite to the contacting side are brought into contact with supply rollers 122. Humidification roller 123 is in contact with supply roller 122 to thereby hold the water held by supply roller 122 on the outer circumferential surface. Long sheet P passes through the humidification nip where the pair of humidification rollers 123 are brought into contact with each other and is thereby humidified with the water held by humidification roller 123.

Draining roller 124 is in contact with the outer circumferential surface opposite to humidification roller 123 of supply roller 122 and drains part of the water held on the outer circumferential surface of supply roller 122 to thereby limit the amount of water held on the outer circumferential surface of supply roller 122 to a certain amount.

A drainage channel (not shown) connected to water storage part 130 is provided on bottom surface 121A of water-boat 121 so that water dropped onto a part of bottom surface 121A returns to water storage part 130 through the drainage channel.

Supply roller 122, humidification roller 123 and draining roller 124 are provided so as to be movable through a moving mechanism (not shown) in the direction in which the respective rollers are arranged side by side. More specifically, supply roller 122, humidification roller 123 and draining roller 124 move between a pressure-contacting position (position in FIG. 7) where the pair of humidification rollers 123 are in contact with each other and a releasing position (position in FIG. 8) where the pair of humidification rollers 123 are separated from each other to release pressure-contacting. The movement of the respective rollers is controlled by control section 101.

More specifically, when long sheet P is conveyed in the second conveyance direction and distortion occurs in long sheet P, control section 101 causes the pair of humidification rollers 123 to move to the pressure-contacting position. In this way, the distortion portion of long sheet P is humidified and the distortion of long sheet P is corrected.

Figure 8:
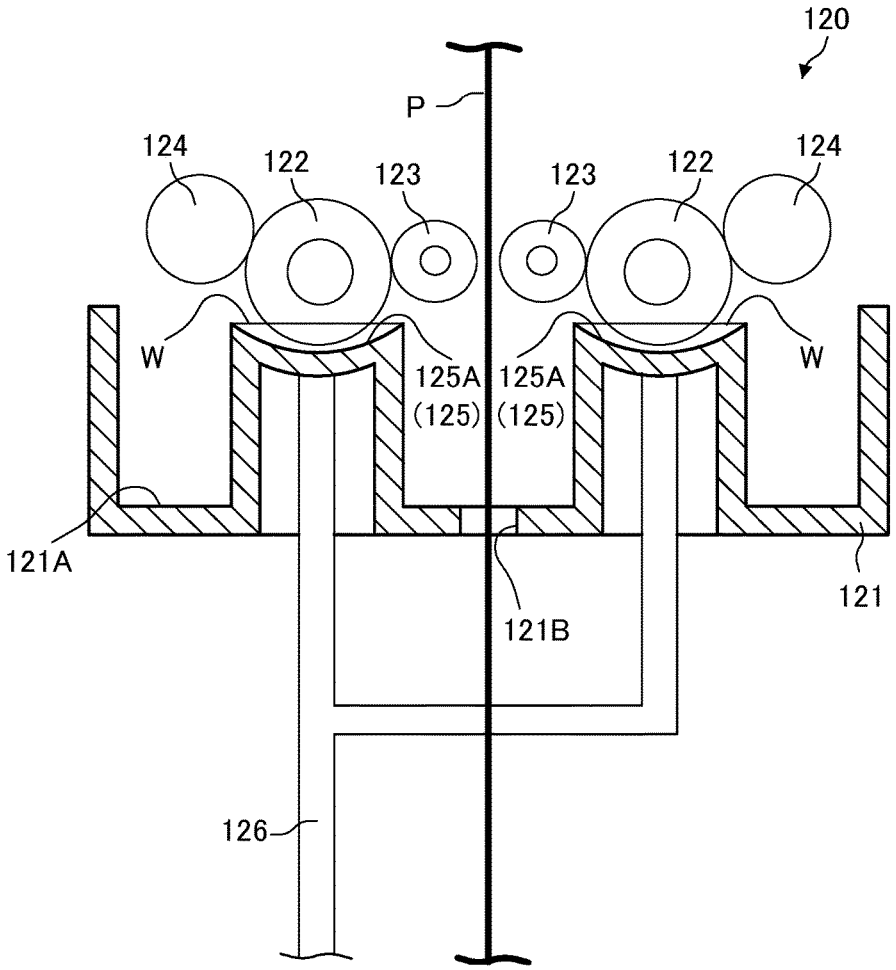
FIG. 8 is a diagram illustrating the humidification section when a humidification roller is located at a releasing position.

As shown in FIG. 8, when long sheet P is conveyed in the second conveyance direction and no distortion occurs in long sheet P, control section 101 causes the pair of humidification rollers 123 to move to a releasing position. Thus, when no distortion occurs in long sheet P, it is possible to prevent long sheet P from being excessively humidified.

When long sheet P is conveyed in the first conveyance direction, control section 101 causes humidification roller 123 in humidification section 120 to move to a releasing position. Here, conveying long sheet P in the first conveyance direction corresponds to a case where long sheet P is conveyed toward the first conveyance direction for normal printing or long sheet P is conveyed toward the second conveyance direction and then long sheet P is conveyed toward the first conveyance direction, that is, long sheet P is rewound and then resent. By so doing, it is possible to prevent useless humidification of long sheet P whose distortion has already been corrected upon resending for overprinting or long sheet P requiring no distortion correction.

Control section 101 adjusts the amount of humidification on long sheet P through humidification section 120 in accordance with the amount of distortion of long sheet P detected by distortion detection section 110. More specifically, control section 101 performs control so as to increase the amount of humidification on long sheet P when distortion of long sheet P is large, and decrease the amount of humidification on long sheet P when distortion of long sheet P is small. On the other hand, when there is no distortion in long sheet P, control section 101 performs control so as not to humidify long sheet P.

Rewound long sheet P can thus be adjusted to an appropriate condition. The amount of humidification on long sheet P can be adjusted by changing the pressure-contacting force of the pair of humidification rollers 123.

Control section 101 controls the amount of distortion correction on long sheet P by humidification section 120 in accordance with information on toner images formed on long sheet P. Distortion of long sheet P varies depending on the degree of deviation to one side or the other side in the width direction of the toner image region formed on long sheet P. Thus, if the amount of distortion correction is controlled with understanding of the information on the toner images in advance, it is possible to perform more accurate distortion correction control.

Figure 9:
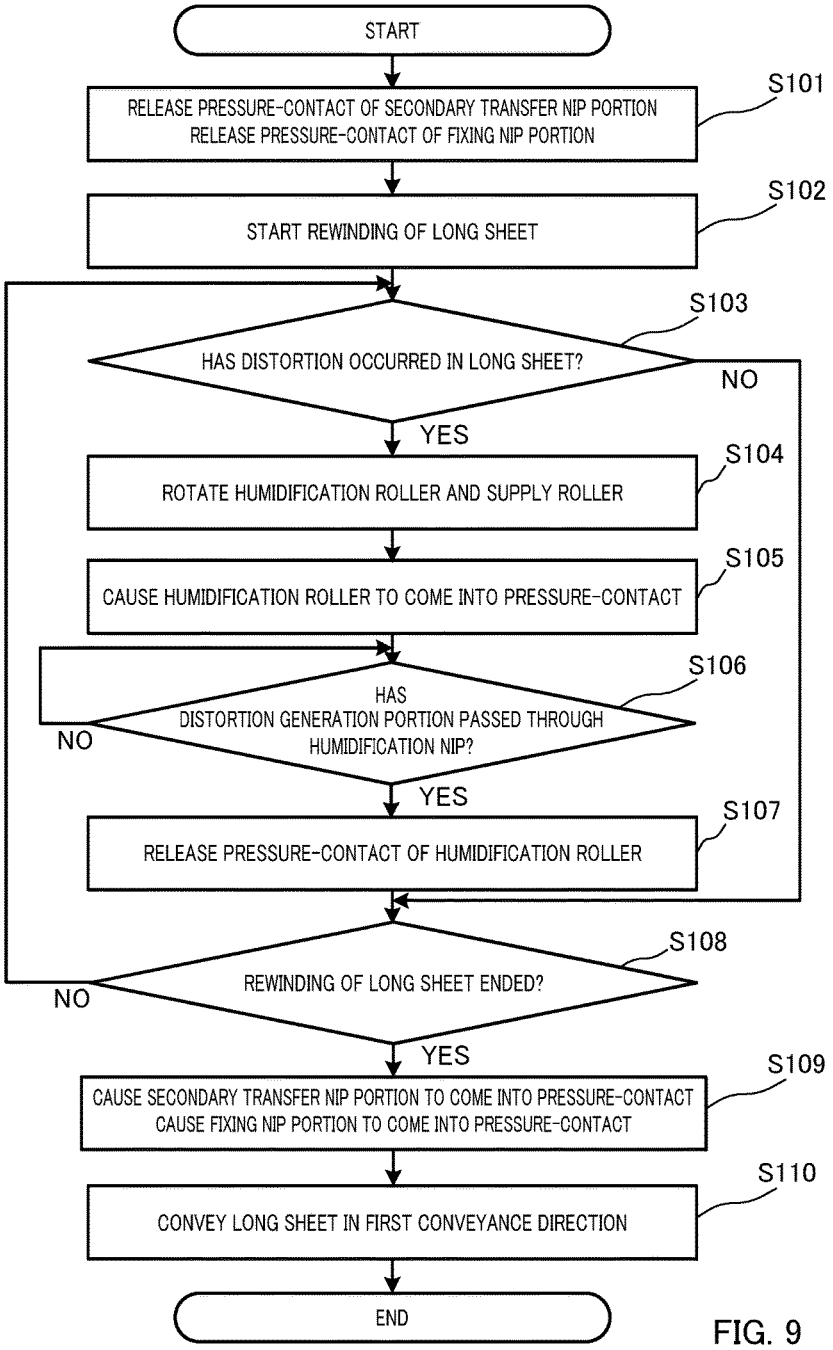
FIG. 9 is a flowchart illustrating an operation example when distortion correction control is performed on a long sheet in the image forming apparatus.

Next, an operation example at the time of performing distortion correction control on long sheet P in image forming apparatus 2 provided with above control section 101 will be described. FIG. 9 is a flowchart illustrating an operation example at the time of performing distortion correction control on long sheet P in image forming apparatus 2. Processes in FIG. 9 are executed during rewinding for overprinting control, that is, upon receiving a conveyance control execution instruction on long sheet P in the second conveyance direction.

First, control section 101 performs control to release pressure-contacting of the secondary transfer nip portion and pressure-contacting of the fixing nip portion (step S101). Next, control section 101 starts rewinding of long sheet P (step S102). More specifically, control section 101 performs control to convey long sheet P in the second conveyance direction.

Next, control section 101 determines whether or not distortion occurs in long sheet P (step S103). When the determination result shows that no distortion occurs in long sheet P (step S103, NO), the process transitions to step S108. On the other hand, when distortion occurs in long sheet P (step S103, YES), control section 101 causes humidification roller 123 and supply roller 122 to rotate (step S104), and then causes humidification roller 123 to perform pressure-contacting (step S105).

Next, control section 101 determines whether or not the portion of long sheet P where distortion has occurred has passed through the humidification nip (step S106). When the determination result shows that the portion of long sheet P where distortion has occurred has not passed through the humidification nip (step S106, NO), the process in step S106 is repeated. On the other hand, when the portion of long sheet P where distortion has occurred passes through the humidification nip (step S106, YES), control section 101 releases the pressure-contacting of humidification roller 123 (step S107).

Next, control section 101 determines whether or not rewinding of long sheet P has ended (step S108). When the determination result shows that rewinding of long sheet P has not ended (step S108, NO), the process transitions to step S103. On the other hand, when the determination result shows that rewinding of long sheet P has ended (step S108, YES), control section 101 brings the secondary transfer nip portion and the fixing nip portion into pressure-contact (step S109). Control section 101 then conveys long sheet P in the first conveyance direction (step S110) and ends the control.

As described in detail above, according to the present embodiment, when distortion correction apparatus 4 conveys long sheet P in the second conveyance direction, that is, when long sheet P is rewound, distortion detection section 110 detects the amount of distortion of long sheet P, the distortion portion of long sheet P passes through humidification section 120 to thereby be humidified, and the distortion of long sheet P is corrected. When long sheet P is resent in the first conveyance direction, it is possible to prevent wrinkles from occurring in long sheet P.

When long sheet P is conveyed in the first conveyance direction, that is, when long sheet P is conveyed normally or rewound and then conveyed again, humidification roller 123 in humidification section 120 is set to a releasing position and it is thereby possible to prevent long sheet P from being uselessly humidified.

Figure 10:
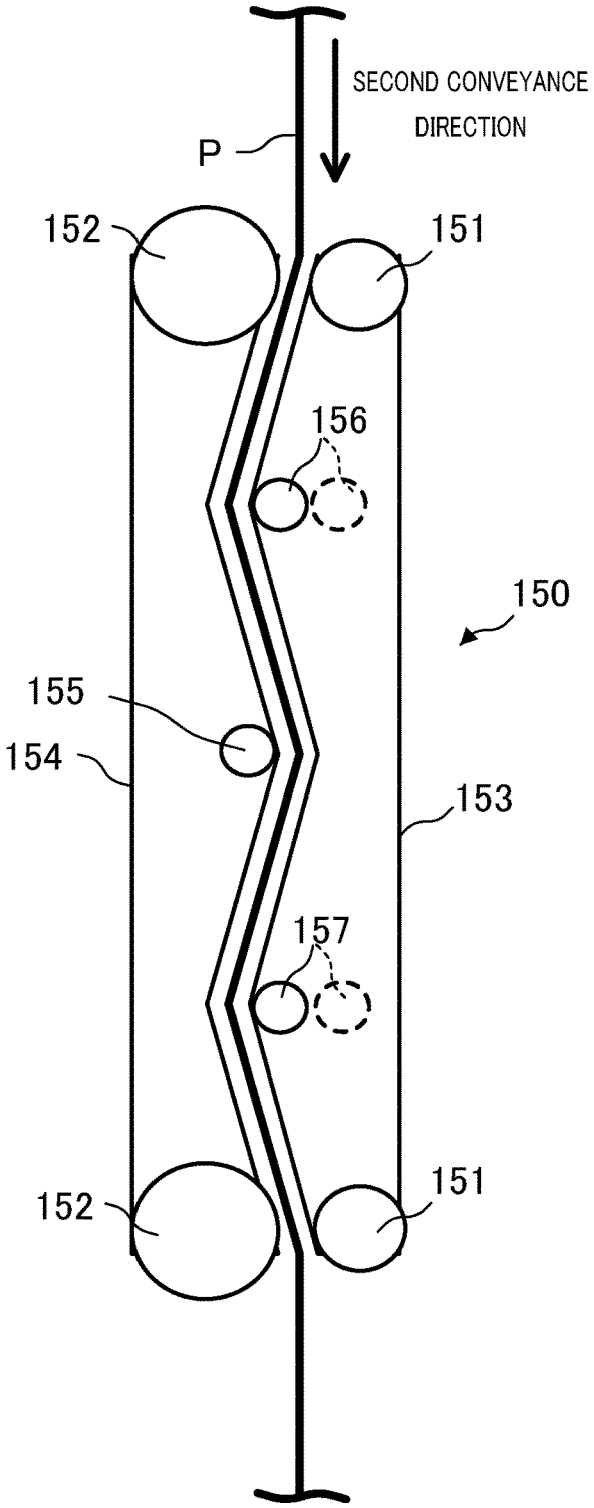
FIG. 10 is a diagram illustrating a curling correction section.

Note that in the above embodiment, distortion of long sheet P is corrected by humidifying long sheet P, but the present invention is not limited to this, and distortion of long sheet P may be corrected by curling correction section 150 that corrects curling of long sheet P as shown in FIG. 10.

More specifically, curling correction section 150 is provided at the position of humidification section 120 in the above embodiment and is provided with first conveyance roller pair 151, second conveyance roller pair 152, first conveyance belt 153, second conveyance belt 154, first fixed roller 155, first movable roller 156 and second movable roller 157.

First conveyance roller pair 151 is disposed on the upstream side and the downstream side in the second conveyance direction separate from each other by a predetermined distance and first conveyance belt 153 is stretched therebetween. Second conveyance roller pair 152 is disposed on the upstream side and the downstream side in the second conveyance direction separate from each other by a predetermined distance and second conveyance belt 154 is stretched therebetween.

First conveyance belt 153 and second conveyance belt 154 are disposed opposite to each other and convey long sheet P sandwiched between the respective opposite surfaces.

First fixed roller 155 is fixed at substantially the central position between two second conveyance rollers 152 in the second conveyance direction and is in contact with the back side of the conveyance surface of long sheet P of second conveyance belt 154.

First movable roller 156 is located at substantially the central position between upper first conveyance roller 151 and first fixed roller 155 in the second conveyance direction and is in contact with the back side of the conveyance surface of long sheet P of first conveyance belt 153.

Second movable roller 157 is located at substantially the central position between lower first conveyance roller 151 and first fixed roller 155 in the second conveyance direction and is in contact with the back side of the conveyance surface of long sheet P of first conveyance belt 153.

First movable roller 156 and second movable roller 157 are movable in the left/right direction in the drawing and movable by means of a cam (not shown) or the like between a correction position (solid line position) where it protrudes toward the second conveyance belt 154 side and a non-correction position (broken line position) where it does not protrude toward the second conveyance belt 154 side.

When first movable roller 156 and second movable roller 157 are located at the correction position, second conveyance belt 154 is pushed by first movable roller 156 and second movable roller 157 via first conveyance belt 153. As a result, the conveyance surfaces of first conveyance belt 153 and second conveyance belt 154 become zigzag, and therefore even in a case where long sheet P is distorted, when long sheet P passes through the zigzag portion, it is possible to correct curling, that is, distortion of long sheet P.

When first movable roller 156 and second movable roller 157 are located at the non-correction position, the conveyance surfaces of first conveyance belt 153 and second conveyance belt 154 become a linear shape. When there is no distortion in long sheet P, causing the conveyance surfaces to become a linear shape makes it possible to smoothly perform conveyance of long sheet P.

In the above embodiment, contactor 114A disposed at second roller 112 detects a contact pressure of long sheet P on distortion detection section 110, but the present invention is not limited to this. The contact pressure of long sheet P on distortion detection section 110 may be detected by providing a piezoelectric element on second roller 112.

In the above embodiment, distortion correction apparatus 4 independent of image forming apparatus 2 corrects distortion of long sheet P, but the present invention is not limited to this, and a distortion correction section may be provided in image forming apparatus 2.

In addition, the above embodiment only shows an exemplary embodiment in implementing the present invention, and the technical scope of the present invention should not be restrictively interpreted by the embodiment. That is, the present invention can be implemented in various forms without departing from the spirit and scope or principal features of the present invention.

What is claimed is:

1. An image forming apparatus comprising:

a conveyance section configured to convey a sheet in a direction opposite to a first conveyance direction during image formation, the direction being a second conveyance direction; and a distortion correction section disposed on an upstream side of a transfer nip in the first conveyance direction and configured to correct, when the sheet is conveyed by the conveyance section in the second conveyance direction, distortion of the sheet generated when the sheet passes through a fixing nip;

wherein the distortion correction section humidifies the sheet to thereby correct distortion of the sheet;

the distortion correction section comprises a pair of humidification rollers configured to humidify the sheet, and the distortion correction section causes the pair of humidification rollers to be in pressure-contact with the sheet when the sheet is conveyed in the second conveyance direction and distortion occurs in the sheet, and the distortion correction section causes the pair of humidification rollers to separate from each other when the sheet is conveyed in the second conveyance direction and no distortion occurs in the sheet.

2. The image forming apparatus according to claim 1, wherein:

the distortion correction section comprises a distortion detection section configured to detect an amount of distortion generated when the sheet passes through the fixing nip, and the distortion correction section controls an amount of distortion correction of the sheet in accordance with the amount of distortion detected by the distortion detection section.

3. The image forming apparatus according to claim 2, wherein:

the distortion detection section detects an amount of inclination in a width direction of the sheet conveyed in the second conveyance direction, and the distortion correction section calculates the amount of distortion of the sheet in accordance with the amount of inclination detected by the distortion detection section.

4. The image forming apparatus according to claim 3, wherein:

the distortion detection section comes into contact with the sheet conveyed by the conveyance section and thereby detects a contact pressure of the sheet with respect to the distortion detection section, and the distortion correction section calculates the amount of distortion of the sheet in accordance with the amount of inclination detected by the distortion detection section and the contact pressure detected by the distortion detection section.

5. The image forming apparatus according to claim 1, wherein, when the sheet is conveyed in the first conveyance direction; the distortion correction section causes the pair of humidification rollers to separate from each other.

6. The image forming apparatus according to claim 1, wherein the distortion correction section controls the amount of humidification of the sheet in accordance with the amount of distortion of the sheet.

7. The image forming apparatus according to claim 1, wherein the distortion correction section corrects curling of the sheet to thereby correct distortion of the sheet.

8. The image forming apparatus according to claim 1, wherein the distortion correction section controls the amount of distortion correction on the sheet in accordance with information on a toner image formed on the sheet.

9. The image forming apparatus according to claim 1, wherein the distortion correction section controls the conveyance section so that the sheet is conveyed toward the second conveyance direction and then conveyed in the first conveyance direction.

10. An image forming system composed of a plurality of units including an image forming apparatus, the image forming system comprising:

a conveyance section configured to convey a sheet in a direction opposite to a first conveyance direction during image formation, the direction being a second conveyance direction; and a distortion correction section disposed on an upstream side of a transfer nip in the first conveyance direction and configured to correct, when the sheet is conveyed by the conveyance section in the second conveyance direction, distortion of the sheet generated when the sheet passes through a fixing nip;

wherein the distortion correction section humidifies the sheet to thereby correct distortion of the sheet;

the distortion correction section comprises a pair of humidification rollers configured to humidify the sheet, and the distortion correction section causes the pair of humidification rollers to be in pressure-contact with the sheet when the sheet is conveyed in the second conveyance direction and distortion occurs in the sheet, and the distortion correction section causes the pair of humidification rollers to separate from each other when the sheet is conveyed in the second conveyance direction and no distortion occurs in the sheet.

11. A computer-readable recording medium storing therein a program for causing a computer of an image forming apparatus to execute processing comprising:

conveying a sheet in a direction opposite to a first conveyance direction during image formation, the direction being a second conveyance direction; and correcting, on an upstream side of a transfer nip in the first conveyance direction when the sheet is conveyed in the second conveyance direction, distortion of the sheet generated when the sheet passes through a fixing nip;

wherein the program causes the computer of the image forming apparatus to execute processing further comprising humidifying the sheet to thereby correct distortion of the sheet;

the image forming apparatus comprises a pair of humidification rollers configured to humidify the sheet, and the program causes the computer of the image forming apparatus to execute processing further comprising causing the pair of humidification rollers to be in pressure-contact with the sheet when the sheet is conveyed in the second conveyance direction and distortion occurs in the sheet, and causing the pair of humidification rollers to separate from each other when the sheet is conveyed in the second conveyance direction and no distortion occurs in the sheet.

12. The computer-readable recording medium according to claim 11, wherein the program causes the computer of the image forming apparatus to execute processing further comprising:

detecting an amount of distortion generated when the sheet passes through the fixing nip; and controlling an amount of distortion correction of the sheet in accordance with the detected amount of distortion.

13. The computer-readable recording medium according to claim 12, wherein the program causes the computer of the image forming apparatus to execute processing further comprising:

detecting an amount of inclination in a width direction of the sheet conveyed in the second conveyance direction; and calculating the amount of distortion of the sheet in accordance with the detected amount of inclination.

14. The computer-readable recording medium according to claim 13, wherein the program causes the computer of the image forming apparatus to execute processing further comprising:

detecting a contact pressure on a part in contact with the sheet being conveyed; and calculating an amount of distortion of the sheet in accordance with the detected amount of inclination and the detected contact pressure.

15. The computer-readable recording medium according to claim 11, wherein the program causes the computer of the image forming apparatus to execute processing further comprising causing the pair of humidification rollers to separate from each other when the sheet is conveyed in the first conveyance direction.

16. The computer-readable recording medium according to claim 11, wherein the program causes the computer of the image forming apparatus to execute processing further comprising controlling the amount of humidification of the sheet in accordance with the amount of distortion of the sheet.

17. Au image forming apparatus comprising:

a conveyance section wherein the conveyance section is configured to convey a sheet in a conveyance path section in a direction opposite to a first conveyance direction in the conveyance path section during image formation, the direction being a second conveyance direction; and a distortion correction section disposed on an upstream side of a transfer nip in the first conveyance direction and configured to correct, when the sheet is conveyed by the conveyance section in the second conveyance direction, distortion of the sheet generated when the sheet passes through a fixing nip;

wherein the distortion correction section humidifies the sheet to thereby correct distortion of the sheet;

the distortion correction section comprises a pair of humidification rollers configured to humidify the sheet, and the distortion correction section causes the pair of humidification rollers to be in pressure-contact with the sheet when the sheet is conveyed in the second conveyance direction and distortion occurs in the sheet, and the distortion correction section causes the pair of humidification rollers to separate from each other when the sheet is conveyed in the second conveyance direction and no distortion occurs in the sheet.

18. An image forming system composed of a plurality of units including an image forming apparatus, the image forming system comprising:

a conveyance section wherein the conveyance section is configured to convey a sheet in a conveyance path section in a direction opposite to a first conveyance direction in the conveyance path section during image formation, the direction being a second conveyance direction; and a distortion correction section disposed on an upstream side of a transfer nip in the first conveyance direction and configured to correct, when the sheet is conveyed by the conveyance section in the second conveyance direction, distortion of the sheet generated when the sheet passes through a fixing nip;

wherein the distortion correction section humidifies the sheet to thereby correct distortion of the sheet;

the distortion correction section comprises a pair of humidification rollers configured to humidify the sheet, and the distortion correction section causes the pair of humidification rollers to be in pressure-contact with the sheet when the sheet is conveyed in the second conveyance direction and distortion occurs in the sheet, and the distortion correction section causes the pair of humidification rollers to separate from each other when the sheet is conveyed in the second conveyance direction and no distortion occurs in the sheet.

19. A computer-readable recording medium storing therein a program for causing a computer of an image forming apparatus to execute processing comprising:

conveying a sheet in a conveyance path section in a direction opposite to a first conveyance direction in the conveyance path section during image formation, the direction being a second conveyance direction; and correcting, on an upstream side of a transfer nip in the first conveyance direction when the sheet is conveyed in the second conveyance direction, distortion of the sheet generated when the sheet passes through a fixing nip;

wherein the program causes the computer of the image forming apparatus to execute processing further comprising humidifying the sheet to thereby correct distortion of the sheet;

the image forming apparatus comprises a pair of humidification rollers configured to humidify the sheet, and the program causes the computer of the image forming apparatus to execute processing further comprising causing the pair of humidification rollers to be in pressure-contact with the sheet when the sheet is conveyed in the second conveyance direction and distortion occurs in the sheet, and causing the pair of humidification rollers to separate from each other when the sheet is conveyed in the second conveyance direction and no distortion occurs in the sheet.

* * * * *